US007059071B2

(12) United States Patent
Hanafusa et al.

(10) Patent No.: US 7,059,071 B2
(45) Date of Patent: Jun. 13, 2006

(54) SELF-PROPELLED WALK-BEHIND SNOWPLOW VEHICLE

(75) Inventors: Jitsumi Hanafusa, Wako (JP); Naotoshi Ono, Wako (JP); Kenji Kamata, Wako (JP); Nobuo Yamazaki, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/919,982

(22) Filed: Aug. 17, 2004

(65) Prior Publication Data

US 2005/0039354 A1 Feb. 24, 2005

(30) Foreign Application Priority Data

Aug. 21, 2003 (JP) ..... 2003-297852
Aug. 21, 2003 (JP) ..... 2003-297874
Aug. 21, 2003 (JP) ..... 2003-297920

(51) Int. Cl.
*E01H 5/09* (2006.01)

(52) U.S. Cl. ..... 37/249; 37/254; 37/256

(58) Field of Classification Search ..... 37/256, 37/227, 257, 244, 243, 249, 254; 172/42, 172/817; 123/41.7, 547
See application file for complete search history.

(56) References Cited

U.S. PATENT DOCUMENTS 4,821,691 A * 4/1989 Ueno et al. ..... 123/185.3
5,438,770 A * 8/1995 Miller ..... 37/227
6,226,966 B1 * 5/2001 Eavenson et al. ..... 56/2
6,318,003 B1 * 11/2001 Heismann ..... 37/257
6,327,799 B1 * 12/2001 Hanafusa et al. ..... 37/257
6,427,364 B1 * 8/2002 Heismann et al. ..... 37/219
6,643,959 B1 * 11/2003 Jolliff et al. ..... 37/244

FOREIGN PATENT DOCUMENTS

JP 60038491 2/1982
JP 64005919 1/1989
JP 2005-68732 * 3/2005

* cited by examiner

*Primary Examiner*—Victor Batson
(74) *Attorney, Agent, or Firm*—Adams & Wilks

(57) ABSTRACT

A self-propelled walk-behind snowplow vehicle has a vehicle body and a vertical engine mounted on an upper part of the vehicle body. The vertical engine has a crankshaft disposed generally vertical and a cylinder head disposed generally horizontal to a longitudinal direction of the snowplow vehicle. The cylinder head projects from the vehicle body in a rearward direction of the snowplow vehicle. Left and right traveling units are mounted on a lower part of the vehicle body at left and right sides thereof. A muffler is connected to the engine and is disposed below the engine and located between the left and right traveling units. The vehicle body and the left and right traveling units together define a downward opening space within which the muffler is disposed.

16 Claims, 8 Drawing Sheets

(COMPARATIVE EXAMPLE)

(COMPARATIVE EXAMPLE)

SELF-PROPELLED WALK-BEHIND SNOWPLOW VEHICLE

BACKGROUND OF THE INVENTION

1. Field of the Invention

The present invention relates to a snowplow vehicle having an engine equipped with a silencer or muffler for reducing the noise level when exhaust gases from the engine pass through the muffler.

2. Background Information

Rotary snowplow machines or vehicles equipped with a snowplow unit disposed at a front end of the vehicle body are known as disclosed, for example, in Japanese Utility Model Laid-open Publication (JP-UM-A) No. 64-5919. The snowplow unit of the disclosed snowplow vehicle comprises a snow worm or auger that delivers snow, a fan blower that throws the delivered snow upwardly, and a guide duct or shooter that guides the thrown snow into a selected direction. The snowplow vehicle has an engine mounted on an upper part of the vehicle body, left and right propelling crawler units disposed on lower left and right sides, respectively, of the vehicle body, and left and right handlebars extending from a rear part of the vehicle body in a backward direction of the vehicle. Thus, the disclosed snowplow vehicle is a self-propelled walk-behind vehicle that is maneuvered by a human operator walking behind the snowplow vehicle while grasping handgrips of the handlebars.

The self-propelled walk-behind snowplow vehicle includes an exhaust system having a muffler disposed on a left side of the engine above the left crawler belt, and a tail pipe extending from the muffler in a lateral outward direction of the snowplow vehicle. The muffler thus disposed is located at a relatively high position. To the operator who is standing near the muffler during snowplow operation, exhaust sound from the muffler is felt loud and unpleasant. Furthermore, the muffler located at a relatively high position may obstruct field of vision of the operator when the operator is looking ahead of the snow auger. A further problem is that when the snowplow vehicle is traveling alongside a snow wall, a stream of exhaust gases emitted from the tail pipe in a lateral outward direction is partly reflected from the snow wall in a backward direction of the snowplow vehicle and thereafter comes into the face of the operator. At the same time, the stream of exhaust gases may splash snow flakes from the snow wall, which will shower onto a body of the operator as the snowplow vehicle travels forward.

Another example of the conventional rotary snowplow vehicles is disclosed in Japanese Patent Publication (JP-B) No. 60-38491. The disclosed snowplow vehicle includes an engine mounted on a body of the vehicle, a top cover disposed on the vehicle body so as to conceal the engine with a space defined between a rear end of the vehicle body and a rear end the top cover, an exhaust pipe extending from the engine downward through the space between the vehicle body and the top cover, and a muffler connected to a lower end of the exhaust pipe.

The muffler thus arranged at a lower position of the snowplow vehicle does not obstruct forward view of the operator. However, since the muffler is disposed at the rear end of the vehicle body, exhaust sound from the muffler is still loud and gives unpleasant feel to the operator. Another drawback associated with the prior arrangement is that the space defined between the rear end of the vehicle body and the rear end of the top cover allows entry of radiant heat from the muffler, which will lower the engine cooling efficiency.

SUMMARY OF THE INVENTION

It is, accordingly, an object of the present invention to provide a self-propelled walk-behind snowplow vehicle having an exhaust system including a muffler arranged to ensure that exhaust sound from the muffler is sufficiently low and does not provide an unpleasant feel to the operator, obstruction-free forward view of the operator is maintained, the operator does not surfer from a blow of exhaust gases or a shower of snow flakes when the snowplow vehicle is traveling alongside a snow wall, and a high engine cooking efficiency can be retained.

According to the present invention, there is provided a self-propelled walk-behind snowplow vehicle comprising: a vehicle body; an engine mounted on an upper part of the vehicle body; left and right traveling units mounted on a lower part of the vehicle body at left and right sides thereof; and a muffler connected to the engine, the muffler being disposed below the engine and located between the left and right traveling units.

This arrangement allows the muffler to be disposed close to a ground surface so that the ground can take up or absorb exhaust sound emitted from the muffler. Additionally, since the position of the muffler is relatively far apart from the position of the head of an operator, the level of exhaust sound transmitted from the muffler to the operator is relatively low. The muffler disposed at such a low position does not obstruct forward view of the operator. Furthermore, particularly in winter seasons, radiant heat from the muffler is taken up or absorbed by the ground of low temperature or snow deposited on the ground surface. The muffler can be cooled with high efficiencies.

In one preferred form of the invention, the engine is a vertical engine having a crankshaft disposed vertically and a cylinder head disposed horizontally. The cylinder head projects from the vehicle body in a backward direction of the snowplow vehicle. The cylinder head of the engine, the vehicle body and the left and right traveling units together define a space open downward. The muffler is disposed in the space.

Preferably, the left traveling unit includes a left side frame extending in a longitudinal direction of the snowplow vehicle, a left driving wheel rotatably mounted on the left side frame, and the right traveling unit includes a right side frame extending parallel to the left side frame, and a right driving wheel rotatably mounted on the right side frame. The left and right side frames are connected together by a cross member, the cross member being disposed rearward of the muffler.

With this arrangement, the left side frame, right side frame and cross member together surround corresponding sides of the muffler and thus protect the muffler from damage. The left and right traveling units serve also as a protection member associated with the muffler. This eliminates the need for a separate protection member.

The self-propelled walk-behind snowplow vehicle may further comprise: a carburetor connected to the engine; a cover enclosing the engine, the cover having an air intake hole formed in a rear end portion thereof and open downward for introducing outside air into the cover and thence to the carburetor; the muffler being disposed below and forwardly of the air intake hole; and a partition wall disposed between the muffler and the air intake hole for blocking direct transmission of radiant heat from the muffler to the rear end portion of the cover including the air intake hole.

By thus blocking direct transmission of radiant heat from the muffler to the rear end portion of the cover including the air intake hole, the radiant heat gives no effect on the temperature of outside air to be introduced from the air intake hole into the cover. Thus, the engine can be cooled with high efficiency.

The partition wall may have an upper end vertically spaced from the cover and defining together with the cover a gap that allows limited transmission of radiant heat from the muffler to the rear end portion of the cover including the air intake hole. The thus transmitted radiant heat will thaw snow deposited around the air intake hole, thereby preventing snow from being drawn into the cover together with outside air, which would otherwise result in the occurrence of icing inside the cover.

Preferably, the cover has a bottom wall formed with an opening from which part of the air that has been used for cooling the engine is discharged, the muffler and the engine are connected together by an exhaust pipe extending vertically through the opening, and the partition wall is disposed rearward of the opening and configured so as to keep the discharged air from flowing behind the partition wall. The partition wall may have a generally U-shaped configuration and is disposed with an open side of the U-shaped configuration facing forward. With this arrangement, the air discharged from the opening can further cool the exhaust pipe.

In another preferred form of the invention, the self-propelled walk-behind snowplow vehicle further comprises an auger housing disposed forwardly of the vehicle body for receiving therein an auger driven by the engine, the auger housing extending in a widthwise direction of the snowplow vehicle. The muffler has a tail pipe so configured as to direct exhaust gases in a forward direction which is diagonal to a longitudinal centerline of the snowplow vehicle to the extent that a stream of exhaust gases discharged from the tail pipe does not strike on the auger housing.

Since the exhaust gases are discharged in a diagonally forward direction of the snowplow vehicle, exhaust sound can hardly be transmitted to the operator walking behind the snowplow vehicle. Additionally, since a stream of exhaust gases emitted from the tail pipe does not strike on the auger housing, it is possible to prevent freezing or icing from occurring inside the auger housing. When the snowplow vehicle is traveling alongside a snow wall, the stream of exhaust gases discharged from the tail pipe is reflected from the snow wall in a forward direction and does not give discomfort to the operator. Furthermore, snow flakes that may be created when the stream of exhaust gases strikes on the snow wall generally scatter in a forward direction of the snowplow vehicle and do not fly back toward the operator walking behind the snowplow vehicle.

BRIEF DESCRIPTION OF THE DRAWINGS

A preferred structural embodiment of the present invention will be described in detail herein below, by way of example only, with the reference to the accompanying drawings, in which.

DETAILED DESCRIPTION OF THE PREFERRED EMBODIMENT

The following description is merely exemplary in nature and is in no way intended to limit the invention or its application or use.

Figure 1:
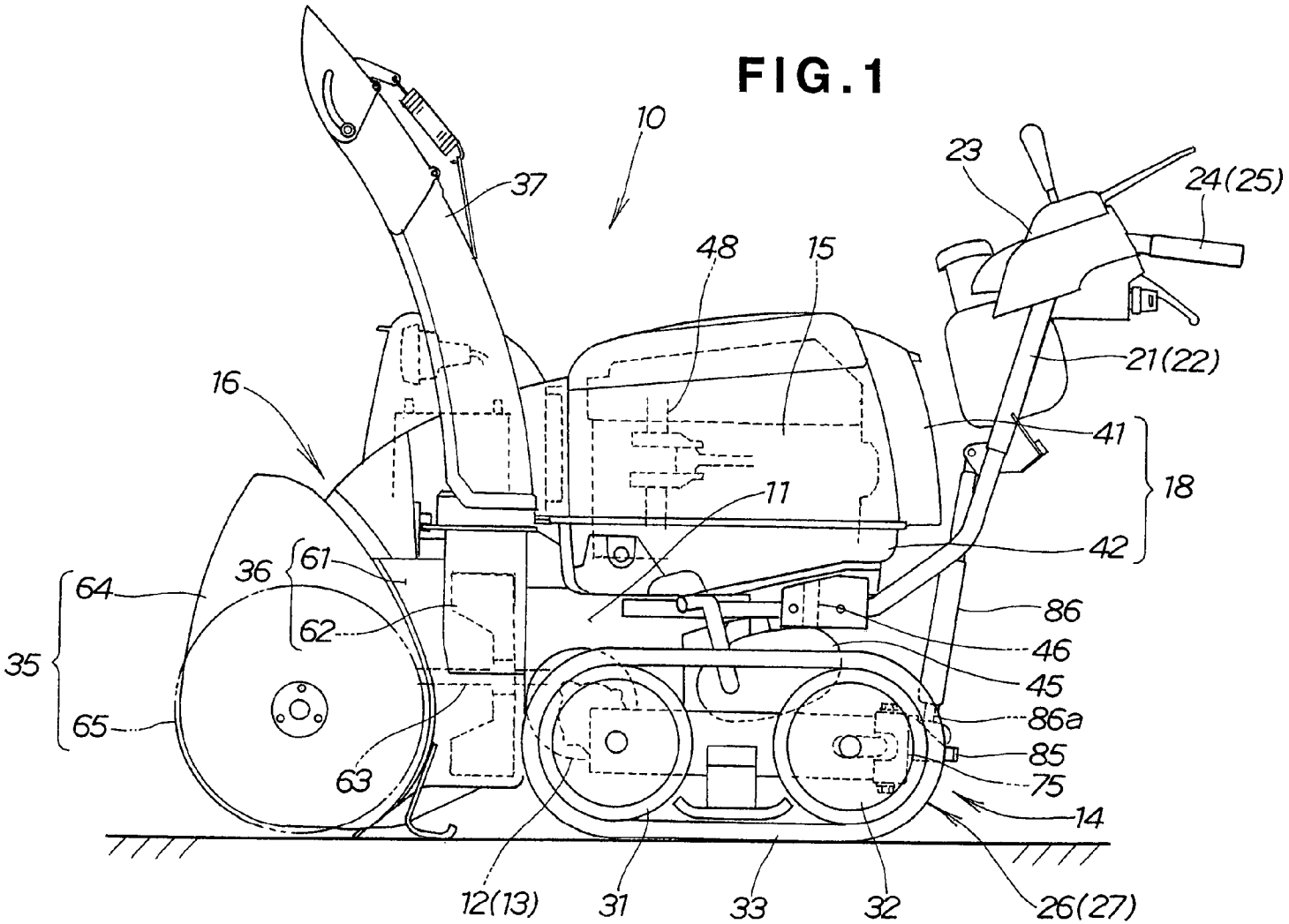
FIG. 1 is a side view of a self-propelled walk-behind crawler snowplow vehicle according to an embodiment of the present invention.

Referring now to the drawings and FIG. 1 in particular, there is shown a self-propelled walk-behind crawler snowplow vehicle 10 according to an embodiment of the present invention. The snowplow vehicle 10 generally comprises a transmission case 11 as a body of the vehicle, left and right electric motors 12 and 13 mounted on left and right sides of a lower part of the transmission case 11, a propelling apparatus 14 disposed on the lower part of the transmission case 11 and operatively connected to the electric motors 12, 13, an engine 15 mounted on an upper part of the transmission case 11, a snowplow unit 16 disposed forwardly of the transmission case 11 and driven by the engine 15, and left and right handlebars 21 and 22 extending backwardly and upwardly from the upper part of the transmission case 11. A rear end portion of the snowplow unit 16 and the engine 15 in its entirety are covered by a cover 18. A silencer or muffler 45 is disposed below the engine 15 and rearward of the transmission case 11, the muffler 45 being connected to the engine 15 via an exhaust pipe 46. The snowplow vehicle 10 also includes an operation control board 23 mounted astride the handlebars 21, 22 at a position near handgrips 24, 25 that are formed at respective distal ends of the handlebars 21, 22. The handgrips 24, 25 are adapted to be gripped by a human operator 113 (FIG. 8B) walking behind the snowplow vehicle 10 in order to maneuver the snowplow vehicle 10.

The propelling apparatus 14 includes a left traveling unit 26 disposed on a lateral outer side of the left motor 12, namely on a left side of the lower part of the transmission case 11, and a right traveling unit 27 disposed on a lateral outer side of the right motor 13, namely on a right side of the lower part of the transmission case 11. The left traveling unit 26 comprises a driving wheel 31 connected in driven relation to an output shaft of the left motor 12, an idler wheel 32 disposed rearward of the driving wheel 31 for free rotation, and a crawler belt 33 trained around the driving wheel 31 and the idler wheel 32.

The right traveling unit 27 has the same structure as the left traveling unit 26 just described above. Accordingly, structural parts of the right traveling unit 27 are designated by the same reference characters as those used in the left traveling unit 26, and further description thereof will be omitted.

The snowplow unit 16 comprises an auger section 35, a rotary blower section 36 and a shooter section 37. The rotary blower section 36 has a blower housing 61 mounted to a front end portion of the transmission case 11, and a blower 62 rotatably disposed in the blower housing 61. The blower 62 is mounted on a drive shaft 63 for rotation therewith. The auger section 35 has an auger housing 64 joined with a front end of the blower housing 61, and an auger 65 rotatably disposed in the auger housing 64.

The cover 18 is composed of an upper cover member 41 configured to cover or enclose the engine 15 from above, and a lower cover member 42 configured to cover a bottom surface of the engine 14. When assembled together to form the cover 18, the upper and lower cover members 41, 42 fully cover the engine 15. The engine 15 is a so-called "vertical" engine having a crankshaft 48 disposed vertically and a cylinder disposed horizontally.

In operation, the left and right motors 12, 13 are driven to rotate the left and right driving wheels 31 so that the left and right crawler belts 33 travel around the driving and idler wheels 31 and 32 to thereby propel the snowplow vehicle 10 in a desired direction. While the snowplow vehicle 10 is traveling forward, motive power from the engine 15 is transmitted to the auger 65 and the blower 62 for driving them to perform a snowplow operation.

Figure 2:
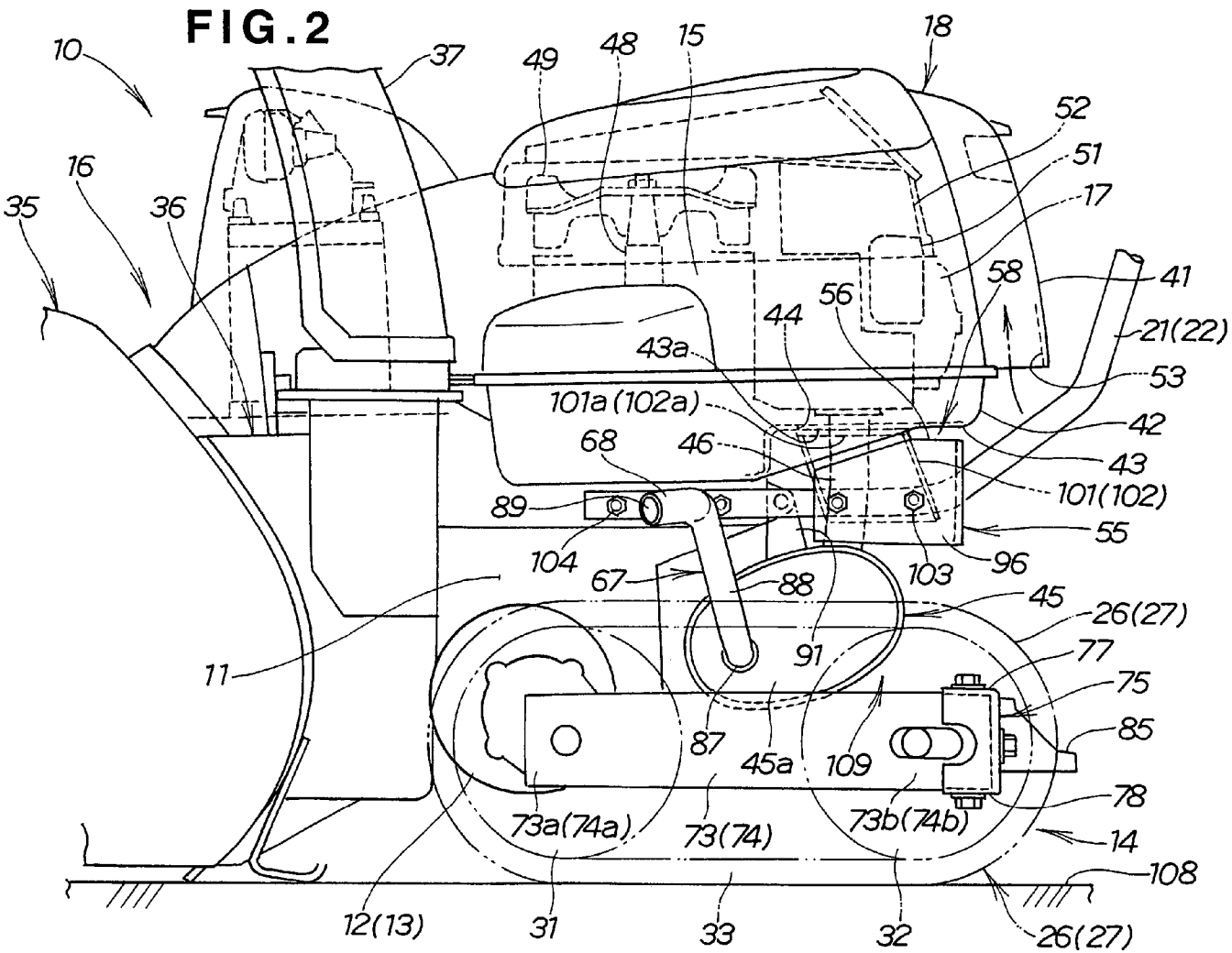
FIG. 2 is a side view showing a part of the snowplow vehicle including an engine and a silencer or muffler connected to the engine.

As shown in FIG. 2, the lower cover member 42 has a bottom wall 43 formed with an opening 44 for the passage therethrough of the exhaust pipe 46. The exhaust pipe 46 extends from the engine 15 in a vertical downward direction through the opening 44 and is connected at a lower end thereof to a body of the muffler 45. Thus the muffler 45 is disposed below the engine 15 and located in a space defied between the left and right traveling units 26, 27 at a rear side of the transmission case 11.

Figure 3:
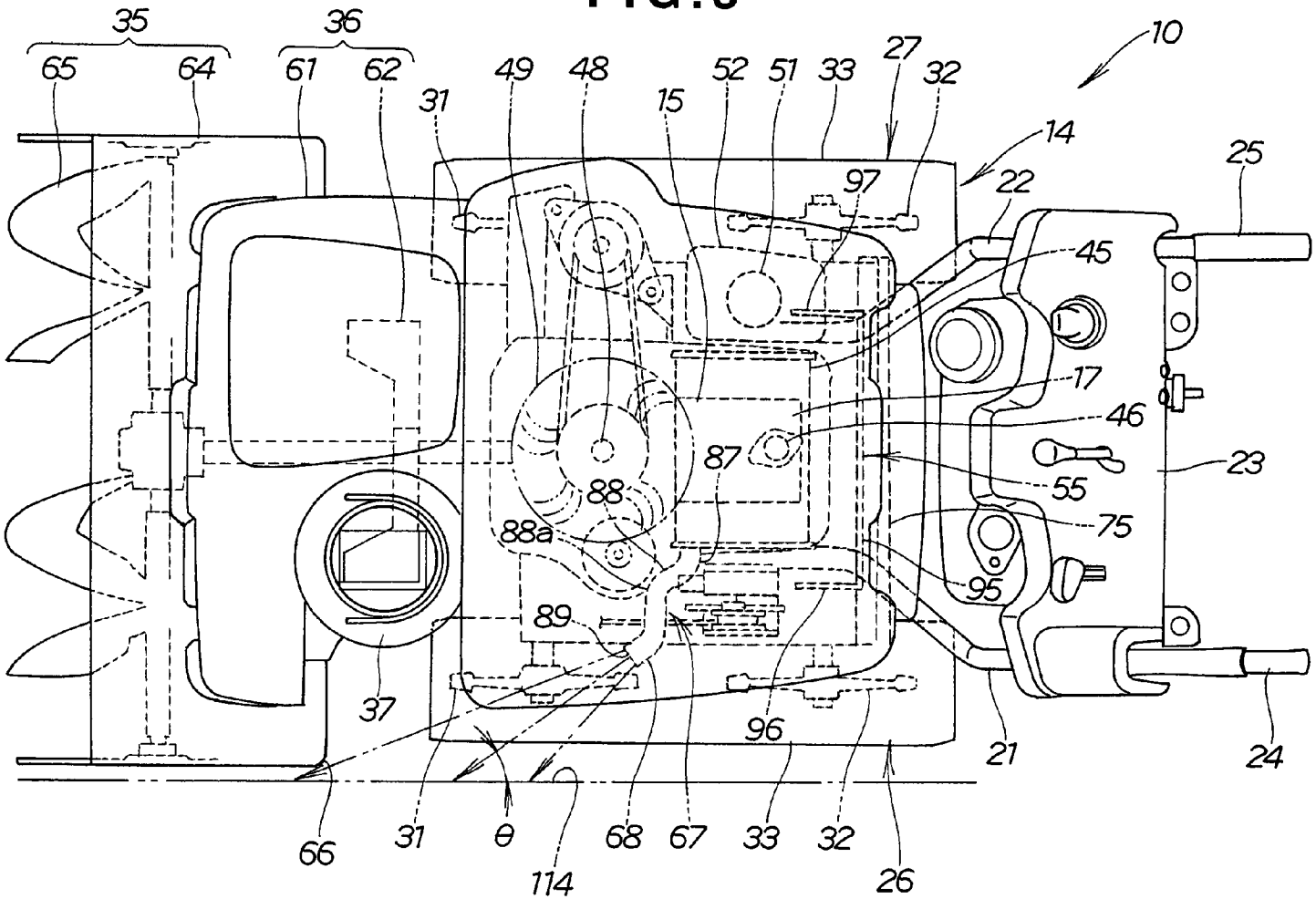
FIG. 3 is a plan view of the snowplow vehicle.

The engine 15 is provided with a carburetor 51 and an air cleaner 52 that are connected to a right side of the engine 15 (see also FIG. 3). The engine 15, carburetor 51 and air cleaner 52 are covered by the cover 18 such that an air intake hole 53 is formed at a rear end portion of the upper cover member 41. The air intake hole 53 opens downward. When the engine 15 is running, the crankshaft 48 rotates a cooling fan 49 so that air outside the cover 18 is drawn or introduced from the air intake hole 53 into the cover 18. The outside air thus introduced is guided by a rear end wall of the upper cover member 41 to flow upward as indicated by the arrow and subsequently introduced into the air cleaner 52 and the carburetor 51 in sequence.

The muffler 45 is disposed below and forward of the air intake hole 53. Stated more specifically, the muffler 45 is disposed substantially beneath a cylinder head 17 of the engine 15 (see also FIG. 3) that is located rearward of the crankshaft 48. The cylinder head 17 is disposed horizontally and oriented backward of the snowplow vehicle 10. The muffler 45 is disposed horizontally with its axis extending in a widthwise direction of the snowplow vehicle 10. A partition wall 55 is disposed between the muffler 45 and the air intake hole 53 in such a manner that a vertical space or gap 58 is formed between an upper edge 56 of the partition wall 55 and the bottom wall 43 of the lower cover member 42.

As shown in FIG. 3, the auger housing 64 is disposed forwardly of the transmission case 11 (FIG. 1) and extending in the widthwise direction of the snowplow vehicle 10, and the blower housing 61 is disposed between the auger housing 64 and the transmission case 11. The engine 15 is mounted on the transmission case 11 for driving the auger 65 and the blower 62 and includes an exhaust system having the muffler 45. The left and right handlebars 21, 22 extend from a rear part of the transmission case 11 in a backward direction of the snowplow vehicle 10.

The muffler 45 has a tail pipe 67 extending from an end wall of the muffler 45 in a widthwise direction of the snowplow vehicle 10. The tail pipe 67 has a discharge end portion 68 bent forwardly at angle θ with respect to a line 114 parallel to a longitudinal centerline of the snowplow vehicle 10. The bent angle θ of the discharge end portion 68 is determined such that a stream of exhaust gases 71 (FIGS. 7A and 7B) discharged from the tail pipe 67 does not strike on or interfere with a left rear corner 66 of the auger housing 64.

If the stream of exhaust gases strikes on the auger housing 64, heat of exhaust gases will melt down snow inside the auger housing 64. The molten snow, i.e., water remaining inside the auger housing 64 may freeze up while operation of the snowplow vehicle 10 is stopped. Icing thus occurring inside the auger housing 64 will hinder or sometimes stop smooth start of the auger section 35. In case of the snowplow vehicle 10 of the invention, such icing problem does not occur because a stream of exhaust gases discharged from the forwardly bent discharge end portion 68 of the tail pipe 67 does not interfere with the auger housing 64. The phantom line 114 shown in FIG. 3 indicates a snow wall formed by the auger section 35 during snowplow operation of the snowplow vehicle 10.

Figure 4:
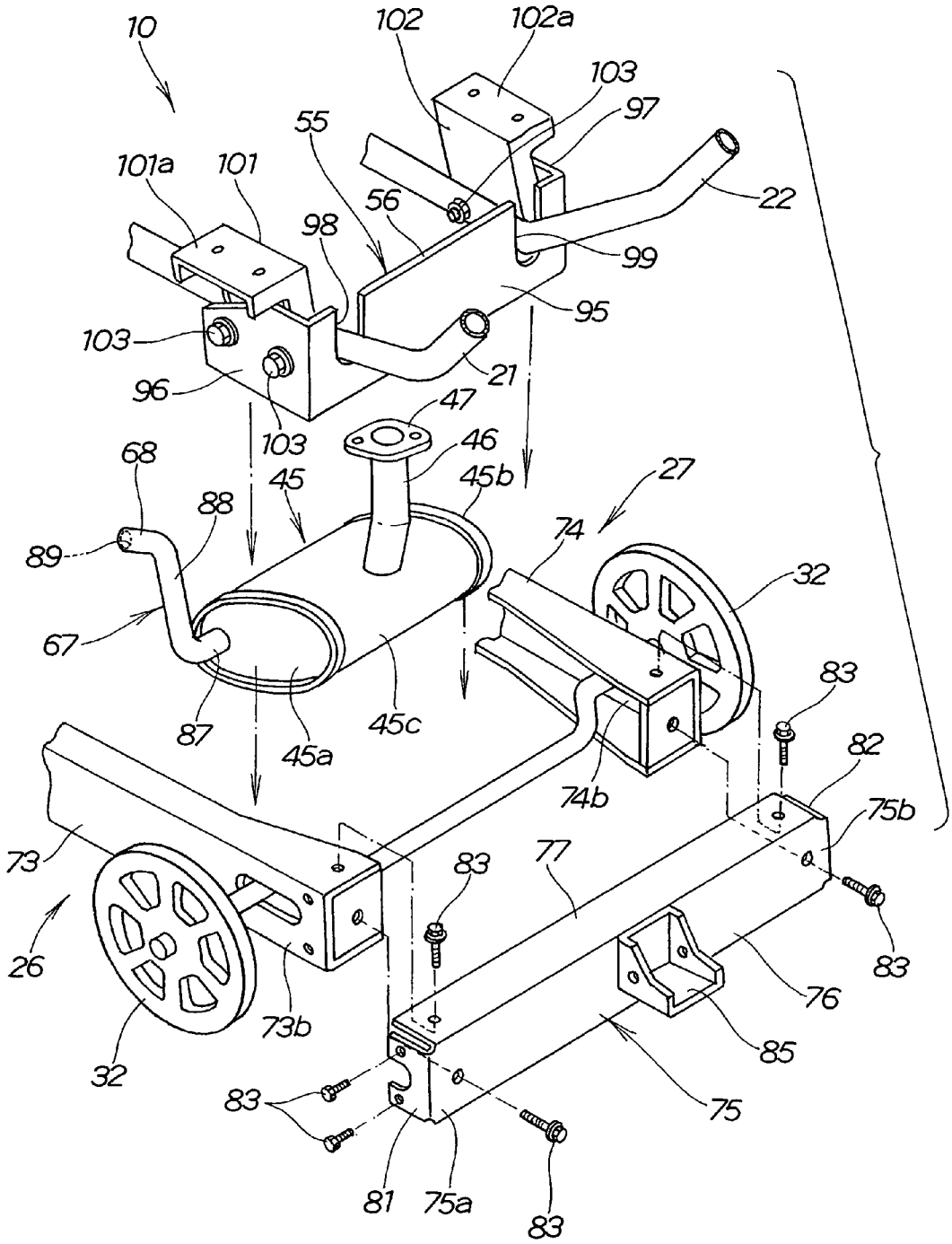
FIG. 4 is an exploded perspective view of a portion of the snowplow vehicle including the muffler and related parts thereof.

As shown in FIG. 4, the left traveling unit 26 includes a left side frame 73 disposed horizontally and extending in a longitudinal direction of the snowplow vehicle. The left driving wheel 32 (FIG. 2) is rotatably mounted on a front end portion 73*a* (FIG. 2) of the left side frame 73, and the left idler wheel 32 is rotatably mounted on a rear end portion 73*b* of the left side frame 73. Similarly, the right traveling unit 27 includes a right side frame 74 extending parallel to the left side frame 73. The right driving wheel 31 (FIG. 2) is rotatably mounted on a front end portion 74*a* (FIG. 2) of the right side frame 74, and the right idler wheel 32 is rotatably mounted on a rear end portion 74*b* of the right side frame 74. Rear ends of the left and right side frames 73, 74 are connected together by a cross member 75. The muffler 45 is disposed between the left and right side frames 73, 74 (namely, between the left and right traveling units 26, 27), and the cross member 75 is disposed behind or backward of the muffler 45.

The cross member 75 has a U-shaped cross section includes a vertical wall 76 and upper and lower horizontal walls 77 and 78 (FIG. 2) extending forwardly from upper and lower edges of the vertical wall 76. Opposite ends of the U-shaped cross member 75 are substantially closed by left and right end walls 81, 82 extending forwardly from left and right end edges of the vertical wall 76. The cross member 75 has a box-like configuration open forward.

For assembly, the cross member 75 of forwardly open box-like configuration is fitted over the rear end portions 73*b*, 74*b* of the left and right side frames 73, 74, and left and right end portions 75*a*, 75*b* of the cross member 75 and the rear end portions 73*b*, 74*b* of the left and right side frames 73, 74 are connected together by a plurality of screws 83.

The cross member 75 has a bracket 85 at a central portion thereof. The bracket 85 is connected to a lower end 86*a* of a cylinder actuator 86 (FIG. 1). The cylinder actuator 86 forms a part of a lift mechanism provided to move the transmission case 11 (FIG. 2) to undergo vertical swinging movement about axes of the left and right driving wheels 31.

As previously discussed, the muffler 45 is disposed between the left and right side frames 73, 74 (i.e., between the left and right traveling units 26, 27) with the cross member 75 disposed behind the muffler 45. With this arrangement, left and right end walls 45*a*, 45*b* of the muffler 45 are protected by the left and right traveling units 26, 27, respectively, and a rear part 45*c* of the muffler 45 is protected by the cross member 75. The muffler 45 thus protected is substantially free from damage. By thus using the traveling units 26, 27 as a protection means, the muffler 45 does not require a separate protection member.

The muffler 45 is in the form of an elliptical cylinder disposed horizontally with its axis extending transversely of the transmission case 11 (FIG. 2). The exhaust pipe 46 extends upward from the rear part 45*c* of the muffler 45 and has a flange 47 at an upper end thereof. The flange 47 is connected to an exhaust manifold of the engine 15 (FIG. 2). The tail pipe 67 extends from the left end wall 45*a* in a lateral outward direction of the snowplow vehicle. The tail pipe 67 has a base portion (proximal end portion) 87 connected to the left end wall 45*a* of the muffler 45, a central portion 88 extending upward from the base portion 87 to the extent that an upper end 88*a* of the central portion 88 is disposed above the left crawler belt 33 (FIGS. 2 and 3), and the discharge end portion 68 extending from the upper end 88*a* of the central portion 88. The discharge end portion 68 is also disposed above the left crawler belt 33 (FIGS. 2 and 3). As shown in FIG. 3, the discharge portion 68 has a bent shape extending from the upper end 88*a* of the central portion 88 first in a lateral outward direction and subsequently in a diagonally forward direction, which is inclined at an angle θ to the longitudinal centerline of the snowplow vehicle 10.

As shown in FIG. 2, the muffler 45 is attached by a bracket 91 to a rear end of the transmission case 11 (FIG. 2). The muffler 45 is disposed below the cylinder head 17 of the engine 15 and located between the left and right traveling units 26, 27. More specifically, the snowplow vehicle 10 has a so-called "dead space" 109 defied between the cylinder head 17 of the engine 15, the rear end of the transmission case 11, the left and right traveling units 26, 27 and a ground surface 108. The muffler 45 is disposed in the dead space 109 for a reason described later.

The partition wall 55 is disposed upwardly and rearward of the muffler 45. As shown in FIG. 4, the partition wall 55 is formed from a single plate bent into a U-shaped configuration for a reason described later. The partition wall 55 has an end plate 95 extending parallel to the rear part 45*c* of the muffler 45, and left and right side plates 96, 97 extending forward from left and right end edges of the end plate 95. The end plate 95 has a pair of U-shaped cutout recesses 98, 99 formed at an upper edge thereof at positions located adjacent the left and right ends of the end plate 95 for the passage therethrough of the left and right handlebars 21, 22, respectively. The left handlebar 21 has a portion extending along an inner surface of the left side plate 96 with a left support bracket 101 disposed therebetween, and the right handlebar 22 has a portion extending along an inner surface of the right side plate 97 with a right support bracket 102 disposed therebetween. The left handlebar 21, the left support bracket 101 and the left side plate 96 of the partition plate 55 are connected together by a pair of bolt-and-nut fasteners 103. Similarly, the right handlebar 22, the right support bracket 102 and the right side plate 97 of the partition wall 55 are connected together by a pair of bolt-and-nut fasteners 103 (only one being shown in FIG. 4). The partition wall 55 is thus attached to the left and right handlebars 21, 22. As shown in FIG. 2, the left and right handlebars 21, 22 have respective forward end portions secured by bolts 104 to left and right side walls of the transmission case 11.

The left and right support brackets 101, 102 have mounting flanges 101*a*, 102*a* (FIG. 4) at upper ends thereof. The mounting flanges 101*a*, 102*a* are connected to a horizontally extending rear part 43*a* of the bottom wall 43 of the lower cover member 42, as shown in FIG. 2. The lower cover member 42 is thus supported at the rear part 43*a* of the bottom wall 43 thereof by means of the left and right support brackets 101, 102.

Figure 5:
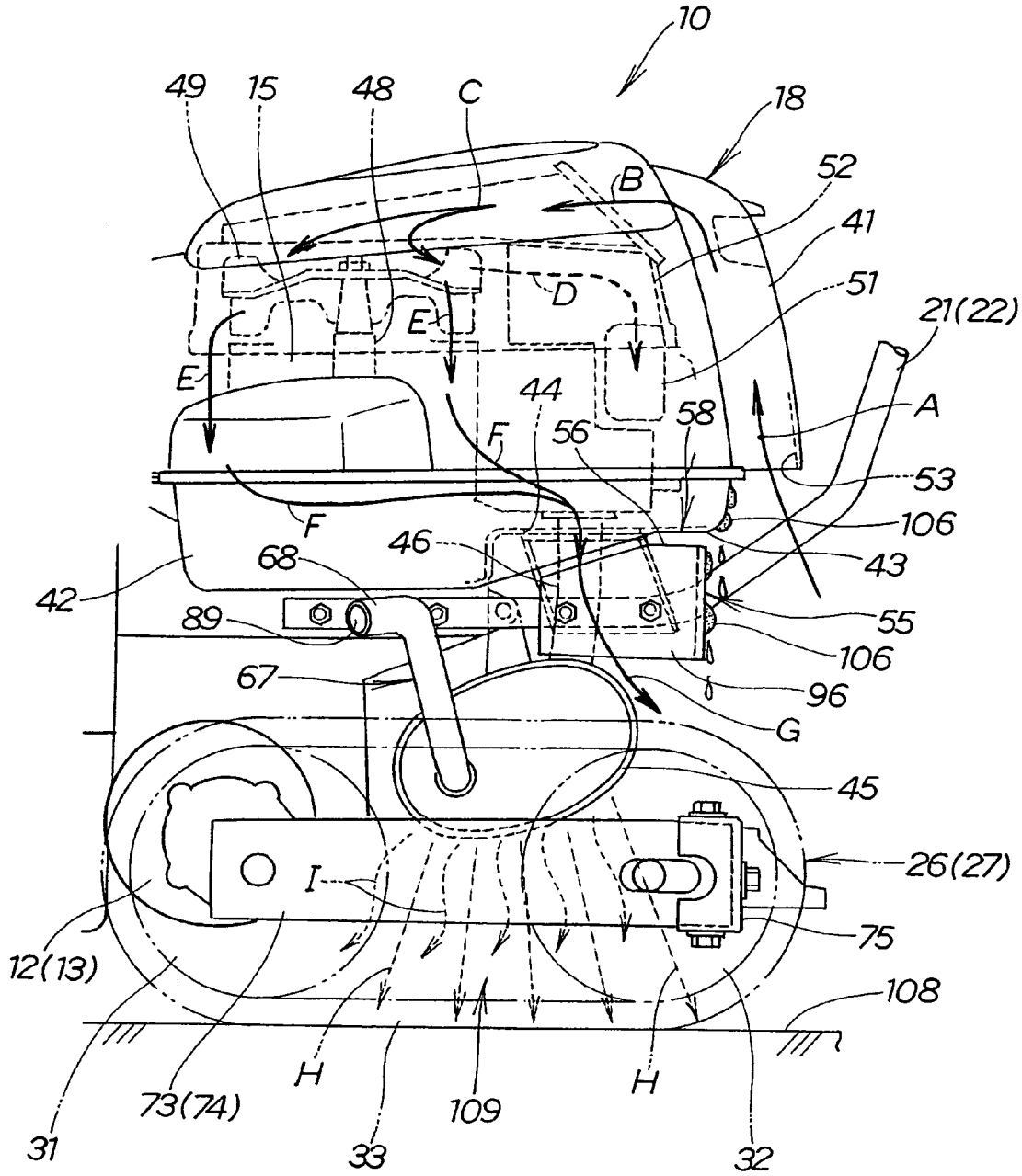
FIG. 5 is a view showing the flow of radiant heat from the muffler.

Operation of the snowplow vehicle 10 of the foregoing construction will be described with reference to FIGS. 5 to 7. FIG. 5 diagrammatically shows the manner of flow or transmission of radiant heat from the muffler 45 and the manner of flow of air introduced in the cover 18. When the engine 15 is running, the crankshaft 48 rotates the cooling fan 49 so that air outside the snowplow vehicle 10 is drawn or introduced from the air intake hole 53 into the cover 18, as indicated by the arrow A. The air is then drawn toward the cooling fan 49 while being guided by an inner surface of the cover 18, as indicated by the arrows B and C. A part of the air is introduced into the air cleaner 52 and thence into the carburetor 51, as indicated by the arrow D. From the carburetor 51 the air is supplied into an intake manifold of the engine 15.

The remaining part of the air is forced against the engine 15 to cool the engine 15, as indicated by the arrow E. After cooling the engine 15, the air is discharged from the opening 44 of the lower cover member 42 into a space extending forwardly of the partition wall 55, as indicated by the arrow F. In this instance, the partition wall 55 guides the air in a downward direction, as indicated by the arrow G, so that the air flows downward along the exhaust pipe 46, thereby cooling the exhaust pipe 46.

By virtue of the partition wall 55 disposed vertically between the air intake hole 53 and the muffler 45, the air discharged from the cover 16 is guided downward toward the muffler 45, as indicated by the arrow G, and is prevented from being introduced again from the air intake hole 53 into the cover 18. By thus blocking reentry of the air into the cover 18, the engine 15 received inside the cover 18 can be cooled with high efficiencies. The partition wall 55 disposed between the muffler 45 and the air intake hole 53 is effective to separate the air intake hole 53 from the muffler 45 to thereby block unlimited direct transmission of radiant heat from the muffler 45 to the air intake hole 53.

When outside air is introduced from the air intake hole 53 into the cover 18 with snow flakes or powders entrained in the air, the snow powders may cause freezing or icing inside the cover 18. To avoid this problem, the vertical space or gap 58 is provided between an upper end of the partition wall 55 and the bottom wall 43 of the cover 18 so that a necessary amount of radiant heat is allowed to transmit from the muffler 45 to the air intake hole 53. The term "necessary amount of radiant heat" means an amount of radiant heat which is sufficient to melt down and vaporize snow 106 adhering to a neighboring part of the air intake hole 53 but does not affect cooling of the engine 15 when introduced from the air intake hole 53 into the cover 18. By thus introducing the necessary amount of radiant heat from the muffler 45 into the air intake hole 53, the snow 106 adhering to the neighboring part of the air intake hole 53 will melt down and become vapor. Furthermore, since the partition wall 55 is heated by radiant heat from the muffler 45, deposited snow 106 on the partition wall 45 can be also melting down and vaporized. This ensures that the air introduced from the air intake hole 53 into the cover 18 is free from snow flakes or powders entrained therein and the freezing or icing problem does not occur inside the cover 18.

As previously described, the muffler 45 is disposed below the engine 15 and located between the left and right traveling units 26, 27. Stated more specifically, the engine 15 (more particularly the cylinder head 17 of the engine 15) and the left and right traveling units 26, 27 define the space 109 open downward, and the muffler 45 is disposed in the space 109. This arrangement allows the muffler 45 to be located near the ground surface 108. The muffler 45 thus arranged is kept sufficiently far from the head of the operator walking behind the snowplow vehicle 10 and does not obstruct forward field of vision of the operator when looking ahead of the auger section 35 (FIG. 2). Furthermore, the ground 108, as indicated by the arrow H in FIG. 5, absorbs exhaust sound emitted from the muffler 45. Thus, substantive reduction of exhaust sound can be achieved. Additionally, the muffler 45 is cooled with high efficiencies because radiant heat emitted from the muffler 45 in a downward direction, as indicated by the arrow I in FIG. 5, can be taken up or absorbed by the ground 108 of low temperature or snow deposited on the ground surface 108.

Figure 6A:
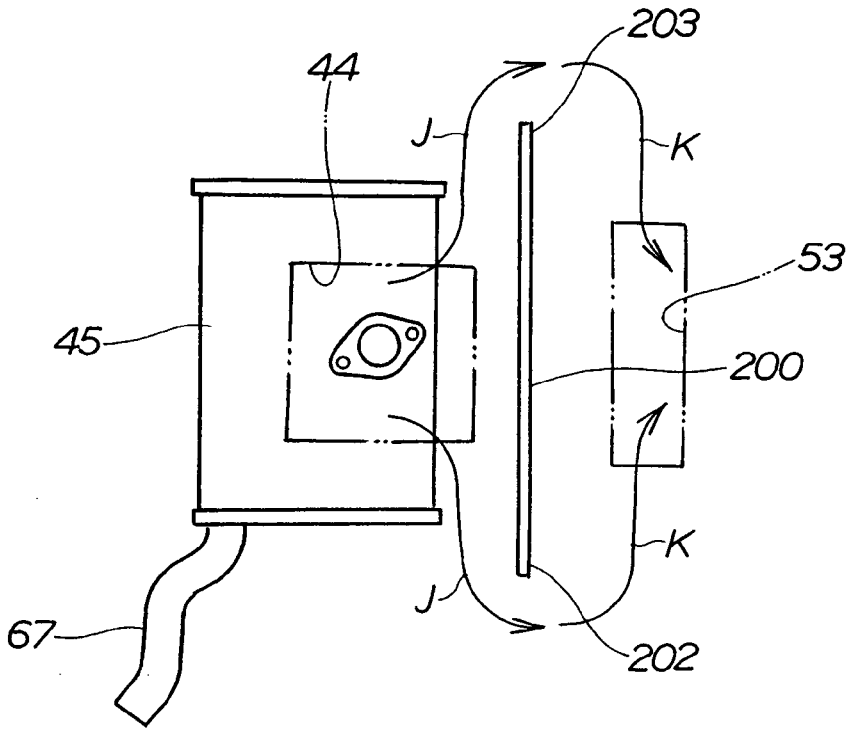
FIGS. 6A and 6B are diagrammatical plan views showing streams of air produced by partition walls of different configurations disposed behind the muffler according to the present invention.

In the illustrated embodiment, the partition wall 55 has a U-shaped configuration, as shown in FIG. 4, the reason for which will become apparent from a description given below with reference to FIGS. 6A and 6B. FIG. 6A shows a partition wall 200 disposed between the muffler 45 and the air intake hole 53 for comparative purposes. The partition wall 200 is formed from a rectilinearly extending elongate plate having a larger length than the muffler 45 and disposed vertically with left and right end edges 202, 203 located outward of left and right end walls (not designated) of the muffler 45. With this arrangement, a part of the air, which has been used for cooling the engine 15 (FIG. 5), is discharged downward from the opening 44 of the cover 18 (FIG. 5). In this instance, the rectilinear partition wall 200 allows the discharged air to flow around the left and right end edges 202, 203 of the partition wall 200, as indicated by the arrows J and K, thus moving from one side of the partition wall 200 facing the muffler 45 to the other side of the partition wall 400 facing the air intake hole 53. The discharged air can be subsequently drawn from the air intake hole 53 into the cover 18 (FIG. 5). Since the discharge air is higher in temperature than the flesh outside air, introduction of the discharged air will lower the cooling efficiency of the engine 15.

Figure 6B:
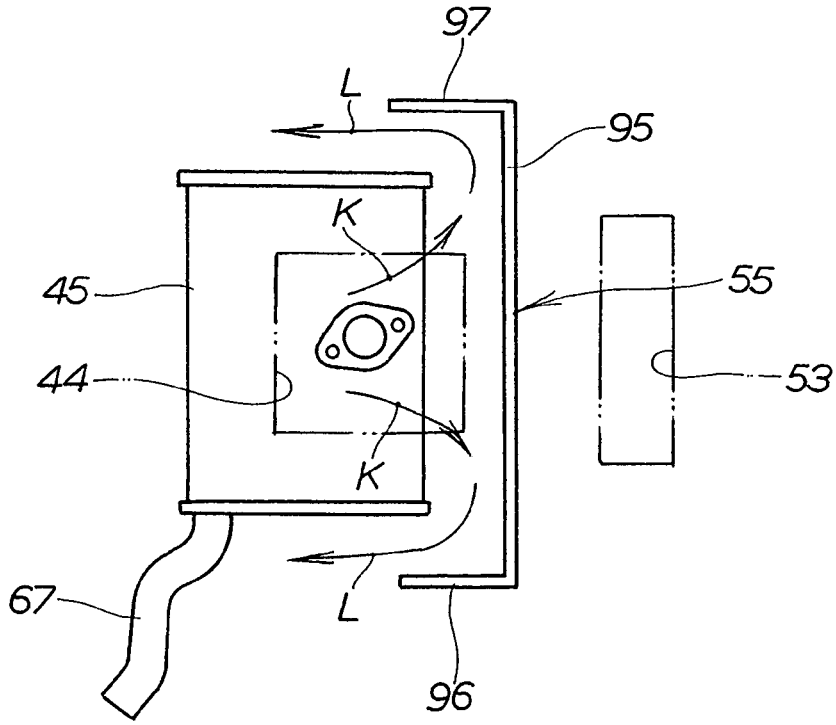

FIG. 6B diagrammatically shows an arrangement in which the partition wall 55 of U-shaped configuration is disposed between the muffler 45 and the air intake hole 53 so that the left and right side plates 96, 97 projecting forward from left and right end edges of the end plate 95 disposed backward of the muffler 45. With this arrangement, a part of the air, which has been used for cooling the engine 15 (FIG. 5), is discharged from the opening 44 in a downward direction. In this instance, since the U-shaped partition wall 55 open forward, the discharged air is guided by the end plate 95 and the left and right side plates 96, 97 to flow in a forward direction (i.e., a direction away from the air intake hole 53), as indicated by the arrows K and L. Thus, the air discharged from the cover 18 (FIG. 5) is prevented from being introduced from the air intake hole 53 into the cover 18. This insures high engine cooling efficiencies.

Figure 7A:
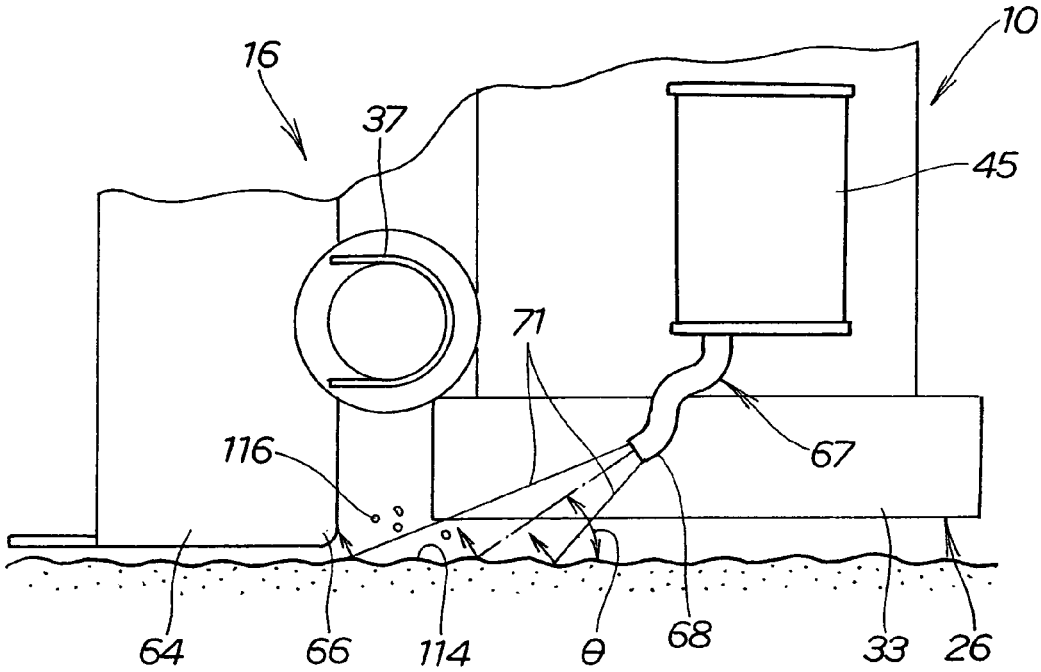
FIGS. 7A and 7B are diagrammatical plan views illustrative of the manner in which exhaust gases are discharged from a tail pipe of the present invention when the snowplow vehicle is traveling alongside a snow wall.
Figure 7B:
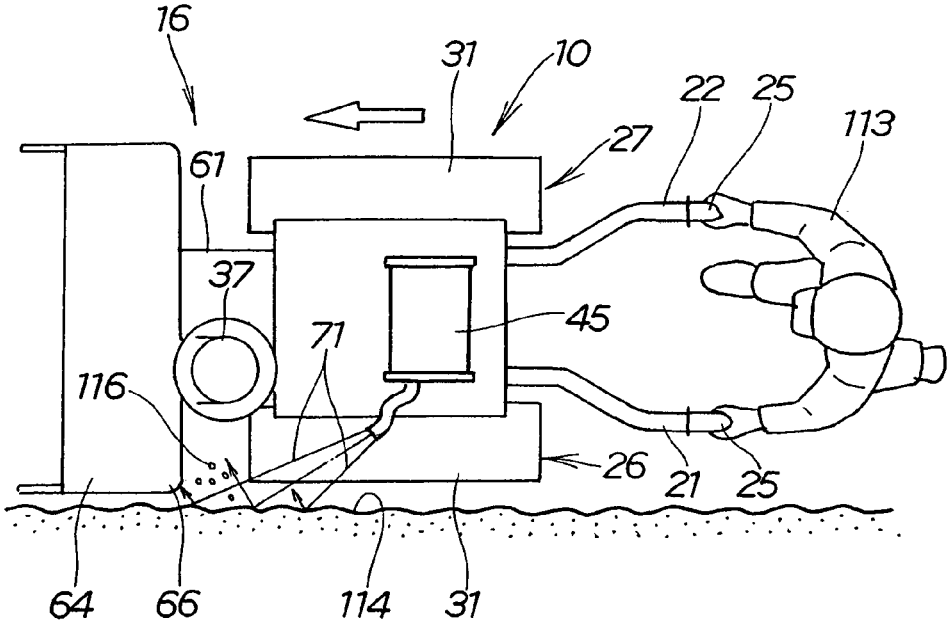
Figure 8A:
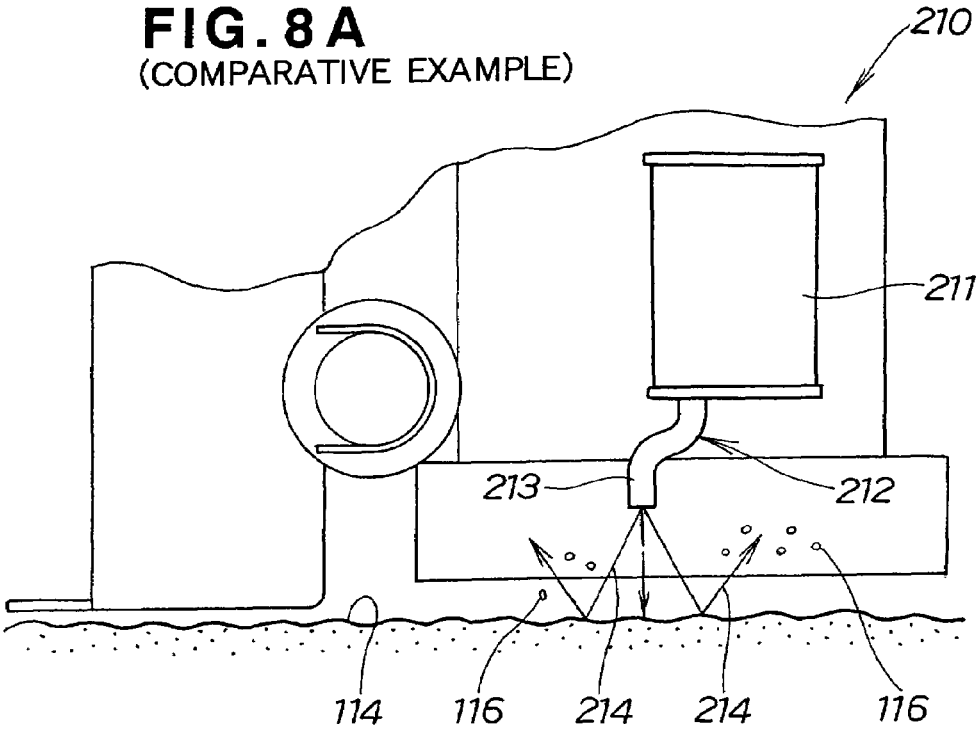
FIGS. 8A and 8B are views similar to FIGS. 7A and 7B, but showing a problem caused by exhaust gases discharged from a tail pipe according to a comparative example.
Figure 8B:
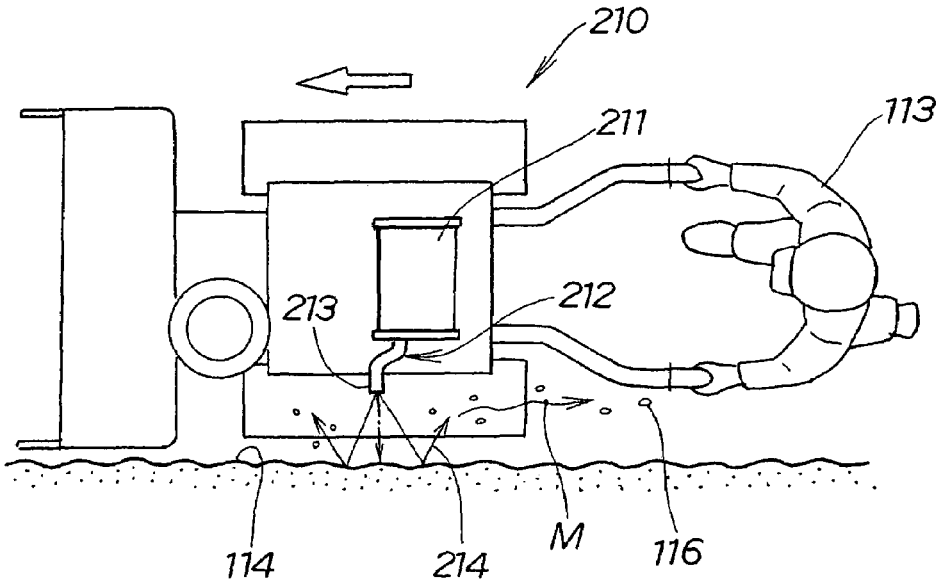

FIGS. 7A and 7B diagrammatical illustrate the manner in which exhaust gases are discharged from the tail pipe 67 of the present invention when the snowplow vehicle 10 is traveling alongside a snow wall 114, and FIGS. 8A and 8B are views similar to FIGS. 7A and 7B, respectively, but shows a problem caused by exhaust gases discharged from a tail pipe 212 of a snowplow vehicle 210 according to a comparative example.

As shown in FIGS. 7A and 7B, the tail pipe 67 extending from the left end wall of the muffler 45 has a discharge end portion 68 bent forward at an angle θ (FIG. 7A) to the longitudinal centerline (not shown but extending substantially parallel to the snow wall 114) so that a stream of exhaust gases 71 discharged from the tail pipe 67 does not strike on or interfere with the left rear corner 66 of the auger housing 64. By thus orienting the discharge end portion 68 of the tail pipe 67, it is possible to prevent the exhaust gas from being reflected from the auger housing 61 in a direction toward the operator 113 (FIG. 7B), to lower the level of exhaust sound emitted from an exhaust system including the muffler 45 and the tail pipe 67, to prevent the exhaust gas from being reflected from the snow wall 114 in a direction toward the operator 113, and allow the exhaust gases 71 to create snow flakes 116 splashed from the snow wall 14 in a forward direction to thereby protect the operator 113 from a shower of snow flakes 116.

As shown in FIGS. 8A and 8B, the tail pipe 212 according to the comparative example has a discharge end portion 213 directed in a lateral outward direction at right angles to a longitudinal center line (not shown but extending substantially parallel to a snow wall 114). With the discharge end portion 213 thus oriented, a stream of exhaust gases 214 emitted from the tail pipe discharge end portion 213 is partly reflected from the snow wall 114 in a backward direction toward the operator 113, as indicated by the arrow M. The thus reflected stream of exhaust gases 214 transfers a high level of exhaust sound directly to the operator 113 and can cause headaches and impaired vision. Furthermore, the stream of exhaust gases 214 may create snow flakes splashed from the snow wall 114 in a backward direction of the snowplow vehicle 210. As the snowplow vehicle 210 moves forward, the snow flakes 116 flow backward and eventually strike as a shower onto a body of the operator 113, causing discomfort to the operator 113.

As thus far explained, the invention is practiced or embodied in a self-propelled walk-behind snowplow vehicle 10 of the type having a snowplow unit 16 including an auger section 35 and a blower section 36. This invention may be practiced or embodied a snowplow vehicle having a different type of snowplow unit. Furthermore, while in the illustrated embodiment, the partition wall 55 is disposed vertically, a backwardly tilted partition wall may alternatively used. Additionally, the partition wall 55 of U-shaped configuration may be replaced with a partition wall having a generally C-shaped configuration. In the illustrated embodiment, the partition wall 55 and the bottom wall 43 of the lower cover member 42 are vertically separated by the space 58. In a modified embodiment, the partition wall 55 may be held in contact with the bottom wall 43 of the lower cover member 42. Furthermore, the partition wall 55 in the illustrated embodiment is bolted to the left and right handlebars 21, 22. The way of attachment of the partition wall 55 should by no means be limited to one shown in the illustrated embodiment but may include another way of attachment wherein the partition wall 55 is attached to the lower cover member 42.

Furthermore, the shape and configuration of the muffler 45 is not limited to an elliptical cylinder as in the illustrated embodiment but may be selected at option. Similarly, the tail pipe 45 has no limitation in shape and configuration thereof except for a particular orientation of the discharge end portion 68. Additionally, the shape and configuration of the cross member 75 is not limited to one shown in FIG. 4 but may include any other variations provided that a cross member as assembled with the left and right side frames 73, 74, can effectively protect a rear part of the muffler 45 from damage.

Obviously, various minor changes and modifications of the present invention are possible in the light of the above teaching. It is therefore to be understood that within the scope of the appended claims the present invention may be practiced otherwise than as specifically described.

What is claimed is:

1. A self-propelled walk-behind snowplow vehicle comprising: a vehicle body; a vertical engine mounted on an upper part of the vehicle body, the vertical engine having a crankshaft disposed generally vertical and a cylinder head disposed generally horizontal to a longitudinal direction of the snowplow vehicle, the cylinder head projecting from the vehicle body in a rearward direction of the snowplow vehicle; left and right traveling units mounted on a lower part of the vehicle body at left and right sides thereof; and a muffler connected to the engine, the muffler being disposed below the engine and located between the left and right traveling units; wherein the vehicle body and the left and right traveling units together define a downward opening space within which the muffler is disposed.

2. A self-propelled walk-behind snowplow vehicle according to claim 1; wherein the left traveling unit has a left side frame extending in the longitudinal direction of the snowplow vehicle and a left driving wheel rotatably mounted on the left side frame; wherein the right traveling unit has a right side frame extending parallel to the left side frame; and a right driving wheel rotatably mounted on the right side frame; and wherein the left and right side frames are connected together by a cross member, the cross member being disposed rearward of the muffler.

3. A self-propelled walk-behind snowplow vehicle according to claim 1; further comprising: a carburetor connected to the engine; a cover enclosing the engine, the cover having an air intake hole formed in a rear end portion thereof and opening downward for introducing outside air into the cover and to the carburetor, the muffler being disposed below and forwardly of the air intake hole; and a partition wall disposed between the muffler and the air intake hole for blocking direct transmission of radiant heat from the muffler to the rear end portion of the cover including the air intake hole.

4. A self-propelled walk-behind snowplow vehicle according to claim 3; wherein the partition wall has an upper end vertically spaced from the cover and defining together with the cover a gap for allowing limited transmission of radiant heat from the muffler through the gap to the rear end portion of the cover including the air intake hole.

5. A self-propelled walk-behind snowplow vehicle according to claim 3; wherein the cover has a bottom wall formed with an opening from which part of air that has been used for cooling the engine is discharged, the muffler and the engine being connected together by an exhaust pipe extending vertically through the opening, and the partition wall being disposed rearward of the opening and configured so as to keep the discharged air from flowing behind the partition wall.

6. A self-propelled walk-behind snowplow vehicle according to claim 5; wherein the partition wall has a generally U-shaped configuration and is disposed with an open side of the U-shaped configuration facing forward.

7. A self-propelled walk-behind snowplow vehicle according to claim 1; further comprising an auger housing disposed forwardly of the vehicle body for receiving therein an auger driven by the engine, the auger housing extending in a widthwise direction of the snowplow vehicle; wherein the muffler has a tail pipe for directing exhaust gases in a forward direction diagonal to a longitudinal centerline of the snowplow vehicle so that a stream of exhaust gases discharged from the tail pipe does not strike on the auger housing.

8. A self-propelled walk-behind snowplow vehicle comprising: a vehicle body; an engine mounted on an upper part of the vehicle body; left and right traveling units mounted on a lower part of the vehicle body at left and right sides thereof; a muffler connected to the engine, the muffler being disposed below the engine and located between the left and right traveling units; a carburetor connected to the engine; a cover enclosing the engine, the cover having an air intake hole formed in a rear end portion thereof and opening downward for introducing outside air into the cover and to the carburetor, the muffler being disposed below and forwardly of the air intake hole; and a partition wall disposed between the muffler and the air intake hole for blocking direct transmission of radiant heat from the muffler to the rear end portion of the cover including the air intake hole.

9. A self-propelled walk-behind snowplow vehicle according to claim 8; wherein the partition wall has an upper end vertically spaced from the cover and defining together with the cover a gap for allowing limited transmission of radiant heat from the muffler through the gap to the rear end portion of the cover including the air intake hole.

10. A self-propelled walk-behind snowplow vehicle according to claim 8; wherein the cover has a bottom wall formed with an opening from which part of air that has been used for cooling the engine is discharged, the muffler and the engine being connected together by an exhaust pipe extending vertically through the opening, and the partition wall being disposed rearward of the opening and configured so as to keep the discharged air from flowing behind the partition wall.

11. A self-propelled walk-behind snowplow vehicle according to claim 10; wherein the partition wall has a generally U-shaped configuration and is disposed with an open side of the U-shaped configuration facing forward.

12. A self-propelled walk-behind snowplow vehicle according to 8; further comprising an auger housing disposed forwardly of the vehicle body for receiving therein an auger driven by the engine, the auger housing extending in a widthwise direction of the snowplow vehicle; wherein the muffler has a tail pipe for directing exhaust gases in a forward direction diagonal to a longitudinal centerline of the snowplow vehicle so that a stream of exhaust gases discharged from the tail pipe does not strike on the auger housing.

13. A self-propelled walk-behind snowplow vehicle according to claim 8; wherein the left traveling unit has a left side frame extending in the longitudinal direction of the snowplow vehicle and a left driving wheel rotatably mounted on the left side frame; wherein the right traveling unit has a right side frame extending parallel to the left side frame; and a right driving wheel rotatably mounted on the right side frame; and wherein the left and right side frames are connected together by a cross member, the cross member being disposed rearward of the muffler.

14. A self-propelled walk-behind snowplow vehicle comprising: a vehicle body; an engine mounted on an upper part of the vehicle body; left and right traveling units mounted on a lower part of the vehicle body at left and right sides thereof; a muffler connected to the engine, the muffler being disposed below the engine and located between the left and right traveling units; and an auger housing disposed forwardly of the vehicle body for receiving therein an auger driven by the engine, the auger housing extending in a widthwise direction of the snowplow vehicle; wherein the muffler has a tail pipe for directing exhaust gases in a forward direction diagonal to a longitudinal centerline of the snowplow vehicle so that a stream of exhaust gases discharged from the tail pipe does not strike on the auger housing.

15. A self-propelled walk-behind snowplow vehicle according to claim 14; wherein the left traveling unit has a left side frame extending in the longitudinal direction of the snowplow vehicle and a left driving wheel rotatably mounted on the left side frame; wherein the right traveling unit has a right side frame extending parallel to the left side frame; and a right driving wheel rotatably mounted on the right side frame; and wherein the left and right side frames are connected together by a cross member, the cross member being disposed rearward of the muffler.

16. A self-propelled walk-behind snowplow vehicle according to claim 14; further comprising a carburetor connected to the engine; a cover enclosing the engine, the cover having an air intake hole formed in a rear end portion thereof and opening downward for introducing outside air into the cover and to the carburetor, the muffler being disposed below and forwardly of the air intake hole; and a partition wall disposed between the muffler and the air intake hole for blocking direct transmission of radiant heat from the muffler to the rear end portion of the cover including the air intake hole.

* * * * *